United States Patent [19]

Catani

[11] Patent Number: 4,869,038

[45] Date of Patent: Sep. 26, 1989

[54] VENEER WALL ANCHOR SYSTEM

[75] Inventor: Mario J. Catani, Buffalo Grove, Ill.

[73] Assignee: Dur-O-Wall Inc., Arlington Heights, Ill.

[21] Appl. No.: 109,408

[22] Filed: Oct. 19, 1987

[51] Int. Cl.[4] ..... E04B 5/00

[52] U.S. Cl. ..... 52/410; 52/712; 52/713

[58] Field of Search ..... 52/378, 379, 383, 410, 52/411, 413, 712, 713, 404

[56] References Cited

U.S. PATENT DOCUMENTS

| | | | |
|---|---|---|---|
| 2,213,355 | 9/1940 | Woodworth | 52/410 X |
| 3,342,004 | 9/1967 | Lucas | 52/712 X |
| 4,606,163 | 8/1986 | Catani | 52/713 X |

OTHER PUBLICATIONS

Dur-O-Wal D/A 213 Veneer Anchor Assemblies.
Hohmann & Barnard, Inc. Catalog, p. 2; Publication Date: 1975.
Masonry Reinforcing Corporation Catalog (4.8/Mas.); Publication Date Unknown.
National Wire Products Corporation Catalog (4.8/Nat); Publication Date Unknown.
AAW Company Catalog, pp. 6–7.
Dur-O-Wal Brochure 4P:Masonry Accessories masonry ties; publication Date: 1986.
Dur-O-Wal Catalog 4:Unit Masonry ties & reinforcement (4.8/Dur); Publication Date: 1980.
Dur-O-Wal Catalog 4 unit masonry (04150/Dur); Publication Date Unknown.
Hohmann and Barnard, Inc. Catalog (4.8/HO); Publication Date Unknown.
Blok-Lok Catalog, pp. 8–9 and 12; Publication Date Unknown.

*Primary Examiner*—David A. Scherbel
*Assistant Examiner*—Creighton Smith
*Attorney, Agent, or Firm*—Jenner & Block

[57] ABSTRACT

A veener wall anchor system interconnects a backup wall of block construction to a brick veneer wall. The system includes a wire joint reinforcement, embeddable in backup wall mortar joints, preformed with a plurality of thin plates welded thereto. When the joint reinforcement is embedded in the backup wall mortar joint, the plates extend outwardly therefrom. A wall of rigid insulation is placed against an outer face of the backup wall with the plates extending through the insulation. The plate includes an elongated aperture outwardly of the insulation for receiving an spring clip fastener which resiliently engages the insulation wall and contact with the backup wall. A pintle tie includes leg portions received in the plate aperture and a U-shaped portion embeddable in mortar joints of the veneer wall to interconnect the veneer wall with the backup wall.

23 Claims, 3 Drawing Sheets

FIG. 2
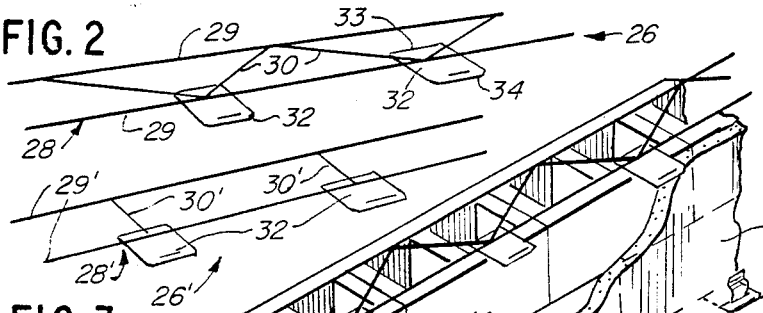
FIG. 1
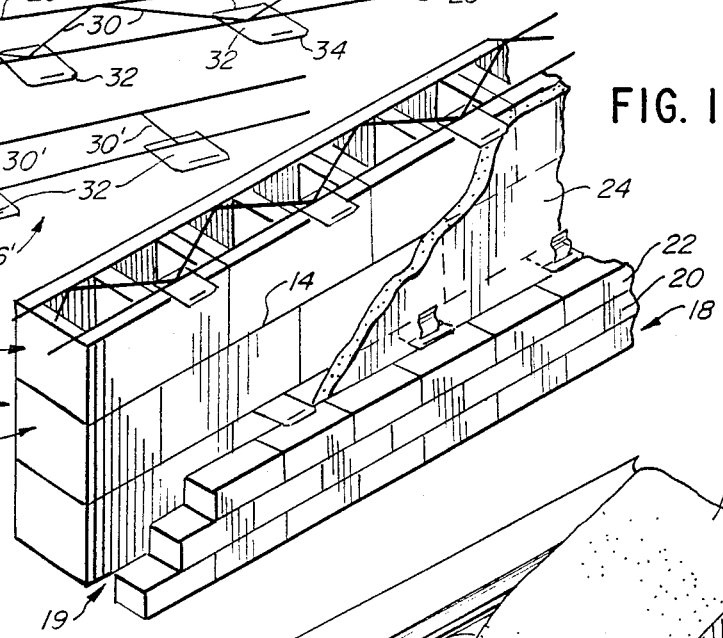
FIG. 3
FIG. 4
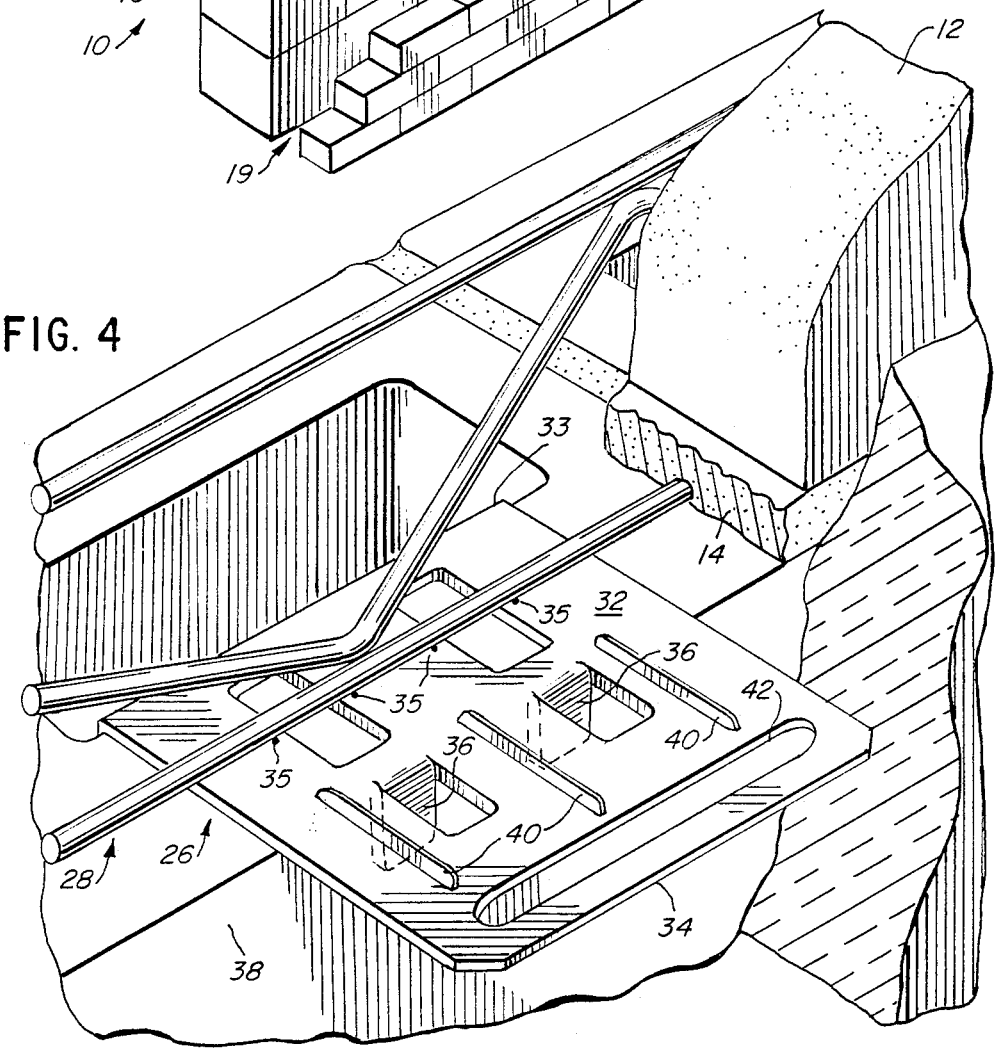

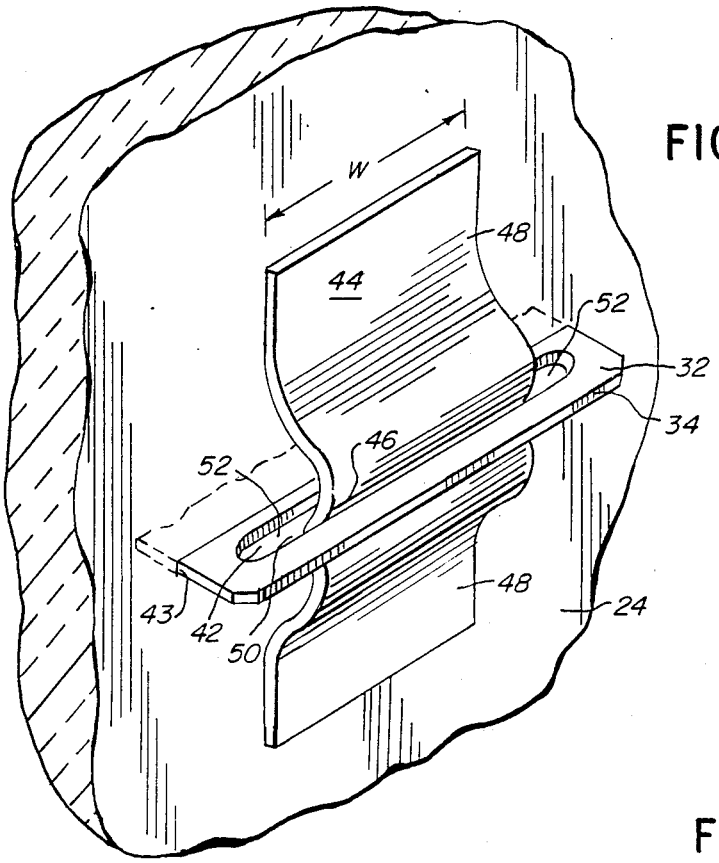
FIG. 6
FIG. 7
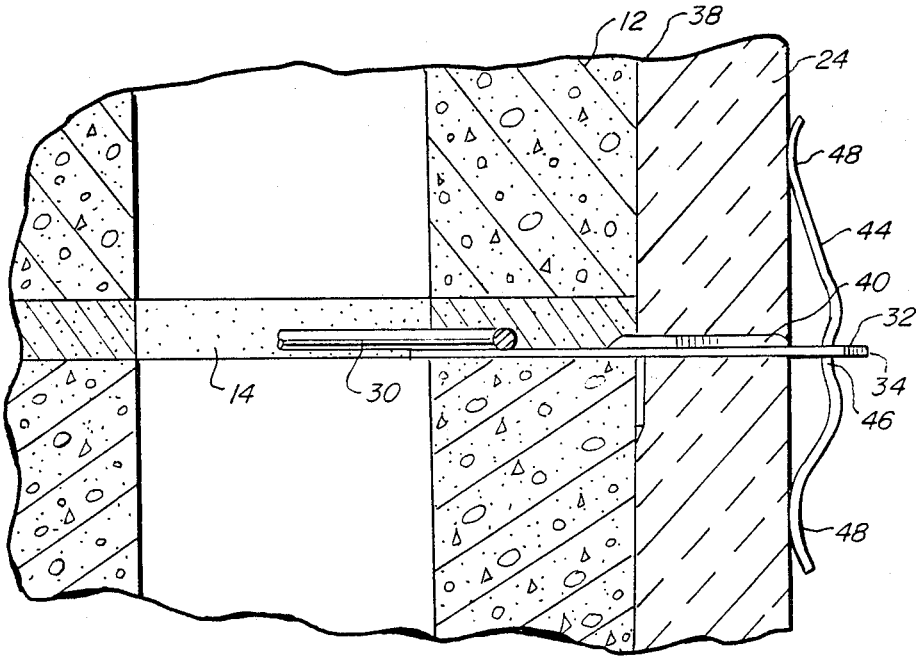

VENEER WALL ANCHOR SYSTEM

Field of the Invention

This invention relates generally to a veneer wall system and more particularly to a veneer wall anchor system including a mounting plate and spring clip for mounting rigid wall insulation.

BACKGROUND OF THE INVENTION

Utilizing conventional construction techniques, many building veneer wall systems are construced including an inner backup wall and an outer veneer wall having a cavity therebetween. The backup wall may be of block construction using, for example, cinder blocks. The veneer wall may be of brick construction. It has long been known to utilize wire joint reinforcements within mortar joints of block walls in order to improve strength characteristics of the wall and to minimize cracking. An additional problem relative to veneer wall systems is the necessity of anchoring the two walls so that structural failure of one wall does not occur independently of the other. Accordingly, tieing elements embedded in the brick wall mortar joints are coupled to the reinforcement to cause both walls to deflect simultaneously and similarly under bending loads so that the resisting movement of the two walls develops a maximum deflection.

When a veneer all anchor system is constructed, it is often desirable to construct the backup wall first, followed by the veneer wall. Such a construction technique may result in the horizontal joints of the respective walls being non-aligned vertically. This result necessitates that the coupling between the wire joint reinforcement in the backup wall and the tieing elements in the veneer wall allow for adjustable vertical spacing therebetween.

One example of a conventional veneer wall anchor system utilizes a truss reinforcement with outwardly extending wire loops welded thereto embeddable in the backup wall horizonal mortal joints. Pintle ties embeddabel in the veneer wall mortar joints are vertically adjustably received in the loops for connecting the veneer wall to the backup wall. A problem with such system is that the weld connecting points between the truss and loops are large in cross section so that the truss arrangement takes up significant vertical space allowing less adjustment to mortar joint thickness.

Veneer wall anchor systems often use rigid wall insulation disposed between the backup wall and the veneer, wall. The insulation may be, for example, secured to the backup wall by a suitable adhesive to secure it in position. Applying such an adhesive can be time consuming and therefore costly. Also, problem results in the holes must be made in the insulation to permit the outwardly extended loops to pass therethrough for coupling with the pintle ties.

The present invention is intended to overcome these and other problems associated with veneer wall anchor systems.

SUMMARY OF THE INVENTION

In accordance with the present invention, a veneer wall anchor system is provided including an improved fastener arrangement for engaging an insulation wall therein.

According to one embodiment of the invention, there is disclosed herein a reinforcement system including a plurality of longitudinally spaced tieing elements having first and second end portions and an open portion adjacent the second end portion. The first end portion is embeddable in mortar joints of a backup wall. The second end portion extends outwardly from the backup wall through a wall of rigid insulation so that the open portion is disposed outwardly beyond the insulation. A spring clip fastener has a central portion received in the tieing element open portion, and opposed distal portions resiliently engaging the insulation wall to retain the insulation wall in contact with the backup wall.

Another feature of this invention is that the tieing elements are secured adjacent their first ends to a wire joint reinforcement itself embeddable in the mortar joint. The wire joint reinforcement includes parallel longitudinal rods connected by a plurality of cross rods. The tieing elements are longitudinally spaced relative to one another.

According to another embodiment of the invention, a reinforcement system comprises a wire joint reinforcement and a plurality of relatively thin plates of generally rectangular shape having first and second ends. Rigid interconnection means are provided for preforming a reinforcement and tie system by welds between the wire joint reinforcement and the plates adjacent the first ends thereof. The plates are longitudinally spaced relative to one another with the plates' second extending outwardly for the backup wall into a cavity between the backup wall and a veneer wall. A plurality of tie means are provided for interconnecting the plates at the second ends thereof to the veneer wall to prevent relative inward and outward movement between the backup wall and the veneer wall.

Another feature of this other invention is that the thin plates include a downwardly extending tab disposed between the two ends engaging the backup wall to laterally position the plate and wire joint reinforcement relative to the backup wall.

A further feature of this invention is that an aperture is provided adjacent the second end of the steel plate for receiving a spring clip fastener resiliently engaging an insulation wall to retain the insulation wall in contact with the backup wall.

Yet another feature of this invention is that the tie means include leg portions which extend through the aperture in the plate for permitting vertical adjustement of the tie means during construction.

Further features and advantages of this invention will readily be apparent from the specification and from the drawings.

BRIEF DESCRIPTION OF THE DRAWINGS

FIG. 1 is a perspective view, with parts broken away for clarity, of a veneer wall system including an anchor system according to the present invention;

FIG. 2 is a perspective view of the preformed reinforcement and tie system of FIG. 1;

FIG. 3 is a perspective view of an alternative preformed reinforcement and tie system;

FIG. 4 is a partial perspective view illustrating in greater detail the preformed reinforcement tie system of FIG. 2 partially embedded in a backup wall mortar joint;

FIG. 6 is a partial perspective view illustrating a spring clip fastener arrangement of the anchor system according to the present invention;

FIG. 7 is a cross-sectional view of the system illustrated in FIG. 6;

DESCRIPTION OF THE INVENTION

Figure 5:
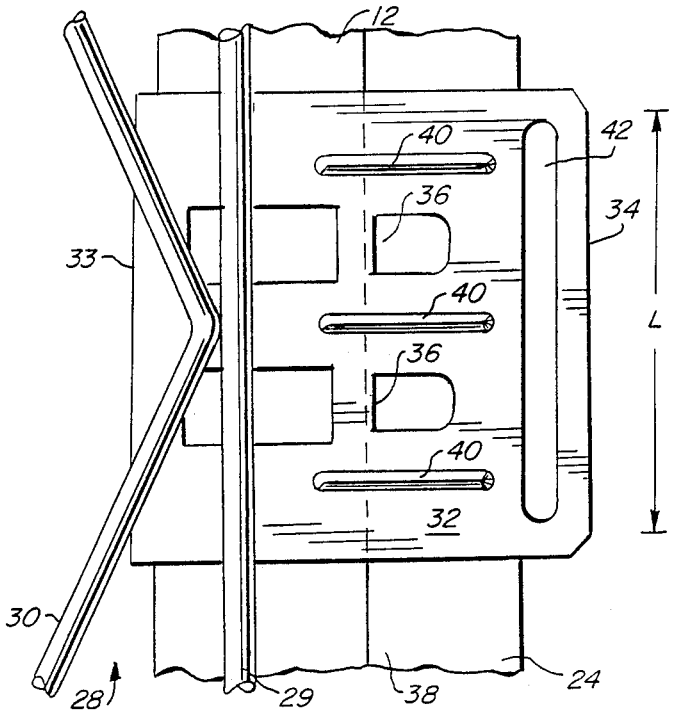
FIG. 5 is a partial plan view of the preformed reinforcement and tie system as illustrated in FIG. 4.

The embodiment of the invention illustrated in the enclosed drawings and specification is a reinforcement system for interconnecting a backup wall to a veneer wall while also resiliently engaging an insulation wall to retain the insulation in contact with the backup wall.

Referring first to FIG. 1, a wall system 10 includes an anchor system according to the present invention. The wall system 10 includes a backup wall 12 of block masonry construction having horizontal mortar joints 14 between vertical rows 16 of blocks. The veneer wall 18 of brick construction is spaced outwardly from the backup wall 12 to define a cavity 19 therebetween. The veneer wall 18 includes mortar joints 20 connecting adjacent bricks 22, both vertically and horizontally. A wall 24 of rigid insulation is disposed between the backup wall 12 and the brick wall 18 partially filling the cavity 19.

The anchor system according to the present invention for interconnecting the backup wall 12, veneer wall 18 and insulation wall 24 is described in greater detail below referring to FIGS. 2–9.

Referring particularly to FIG. 2, a preformed reinforcement and tie system 26 is illustrated. The system 26 includes a wire joint reinforcement 28 including parallel longitudinal rods 29 connected by a plurality of diagonally extending cross rods 30. The cross rods 30 may be of continuous wire construction in a zigzag pattern with turned portions thereof connected as by welds (not shown) to the longitudinal rods 29. A plurality of longitudinally spaced, relatively thin generally rectangular plates 32 have first and second ends 33 and 34, respectively. The system 26 includes rigid interconnection means, as welds 35 (see FIG. 4), between the wire joint reinforcement 28 and the plates 32 adjacent the first ends 33 thereof. The sytem 26 is embeddable in the horizontal mortar joints 14 whereby the plate second ends 34 extend outwardly thereof. The reinforcement 28 acts to improve strength characteristics of the backup wall 12 when it is embedded in the mortar joints 14 thereof. The welding of a thin steel plate 32 to the wire joint reinforcement 28 results in a preformed reinforcement and tie system 26 of relatively thin cross sectional dimension enabling mortar joint thickness to be adjusted over a greater range.

Referring to FIG. 3, an alternative preformed reinforcement and tie system 26' is shown. This system 26' is similar to that illustrated in FIG. 2, except for the diagonally oriented cross rods 30 of FIG. 2 being replaced by a plurality of spaced perpendicular cross rods 30'. The wire joint reinforcement 28' of FIG. 3 is known as a Ladur-type ® reinforcement (Ladur-type is a registered trademark of Dur-O-Wal, Inc., the assignee of the present invention).

Referring particularly to FIGS. 4 and 5, the preformed reinforcement and the system 26 is illustrated partially embedded in the mortar joint 14 of the backup wall 12. The plates 32 include a pair of downwardly extending knockdown tabs 36 disposed between the first and second ends 33 and 34, respectively. The knockdown tabs 36 are abutted against an outer face 38 of the backup wall 12 during wall construction and act as an indexing guide to laterally position the preformed reinforcement and tie system 26 relative to the backup wall 12 to insure that the joint reinforcement 28 has proper mortar cover to minimize corrosion of the joint reinforcement 28 which might discolor the mortar joints 14 and the backup wall 12. The plate 32 also includes stiffening gussets 40 to add strength to the plate 32. The use of stiffening gussets 40 permits the plate 32 to be provided of relatively thin construction. An elongated aperture 42 through the plate 32 is parallel and adjacent to the second end 34 thereof. The aperture 42 is utilized to interconnect the insulation wall 24 and veneer wall 18, as it is discussed more specifically below.

Referring particularly to FIG. 5, the spacing between the knockdown tab 36 and the aperture 42 is also provided so that when the preformed system 26 is embedded in the morter joint 14, and the insulation wall 24 is placed against the outer face 38 of the backup wall 12, the aperture 42 is disposed immediately outwardly from the insulation wall 24. As the insulation wall 24 may be of different thicknesses for different applications, a variety of different plates 32 can be provided with the distance between the knockdown tab 36 and the aperture 42 being selected in part according to the thickness of the insulation 24.

Referring also to FIGS. 6 and 7, the plate 32, extends through an opening 43 in the insulation wall 24 so that the second end 34 is disposed outwardly beyond the insulation wall 24. The plate 32 is thin enough so that second end 34 thereof pierces the insulation 24 during the construction process when the insulation 24 is forced inwardly towards the outer face 38 of the backup wall 12 to provide the opening 43. Accordingly, it is not necessary that joints between adjacent pieces of rigid insulation be aligned with the plates 32.

A spring clip fastener 44 of, for example, spring steel includes a central lateral concave portion 46 connecting opposite inwardly turned distal portions 48. To insert the spring clip 44, one end portion 48 is inserted through the aperture 42 and the central portion 46 is forced inwardly to permit vertical movement until the clip is locked in place when released. The spring clip fastener 44 is thus mounted in the aperture 42 of the plate 32 whith the concave portion 46 engaging an outermost edge 50 of aperture 42, to prevent vertical movement of the clip 44 and so that the opposed distal portions 48 resiliently engage the insulation wall 24 to retain the insulation wall 24 in contact with the outer face 38 of the backup wall 12. The spring clip 44 can be easily removed, if necessary, by placing an inward pressure at the central portion 46 so that it laterally clears the edge 50 to permit vertical movement. Such a construction results in the insulation wall 24 being readily secured to the backup wall with minimal damage to the insulation than might result from other construction techniques.

Figure 8:
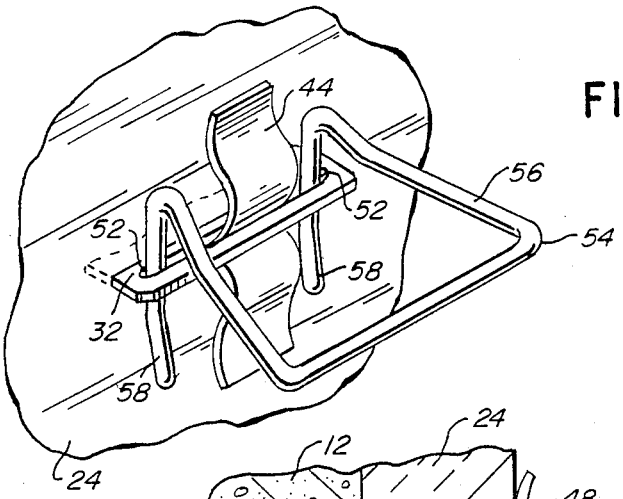
FIG. 8 is a partial perspective view illustrating a pintle tie received in the tieing plate of FIGS. 6 and 7.
Figure 9:
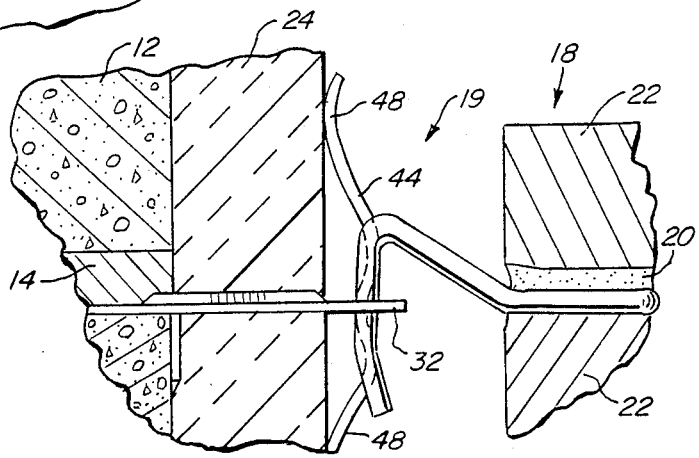
FIG. 9 illustrates in partial cross-sectional view the complete constructed veneer wall and anchor system according to the present invention.

The width W of the fastener 44 is sized to be less than the length L of the aperture 42 (see FIG. 5) so that an open portion 52 is provided at each end of the aperture 42 when the spring clip fastener 44 is mounted therein, as discussed above. Referring to FIG. 8, a wire pintle tie 54 includes a generally U-shaped portion 56 connecting opposite downwardly turned leg portions 58. The leg portions 58 are receivable in the respective open portions 52 of aperture 42. When the veneer wall 18 is constructed, the legs 58 are vertically slidably received within the openings 52 according to the relative vertical position between the veneer wall mortar joints 20 and the backup wall mortar joints 14. The U-shaped portion 56 is then embedded in the brick wall mortar joints 20 to interconnect the backup wall 12 with the veneer wall 18. Accordingly, the respective mortar joints need not be directly vertically aligned. The longitudinal length of the aperture 42 is greater than the spacing between the legs 58. Thus, the interconnection between the legs 58 and the aperture 42 also allows for differential horizontal movement between the backup wall 12 and the veneer wall 18.

The interconnection of the backup wall 12 and veneer wall 18 prevents relative inward and outward movement between the two walls, as discussed above. While the present invention is illustrated in the drawings relative to a complete wall reinforcement and insulation system, different variations of the anchor system may be utilized as called for in a particular application. For example, where wire joint reinforcements 28 are not necessary for the backup wall 12, the steel plates 32 can be provided themselves embeddable in the backup wall mortar joints 14. Such a construction would result in the backup wall 12 and veneer wall 18 being interconnected without the backup wall 12 itself being reinforced by the wire joint reinforcement 28.

Alternatively, in an application where interconnection to a veneer wall is not necessary, the plates 32 can be utilized to retain an insulation wall 24 in contact with any type of wall having horizontal, or vertical connecting joints.

Other variations of the disclosed invention would be apparent to one skilled in the art and therefore are not specifically discussed herein.

While the anchor system according to the present invention is described herein in connection with a backup wall 12 of block construction and a brick veneer wall, the anchor system could also be utilized with various other types of walls.

Thus, the invention broadly comprehends a reinforcement system for simply and reliably interconnecting the various wall components during building construction.

The foregoing disclosure of the embodiments herein are illustrative of the broad inventive concepts comprehended by the invention.

I claim:

1. An anchor system for a wall system including a backup wall, a veneer wall, and a wall of rigid insulation disposed between said backup wall and said veneer wall, said anchor system comprising:

A plurality of longitudinally spaced tieing elements having first and second end portions and an open portion adjacent said second end portion, said first end portion being securable to said backup wall, said second end portion extendable outwardly from said backup wall through said rigid insulation so that said open portion may be disposed outwardly beyond said insulation; and a spring clip fastener having a central portion receivable in said tieing element open portion, and opposed distal portions resiliently engagable with said insulation wall to retain said insulation wall in contact with said backup wall.

2. The anchor system of claim 1 wherein said tieing elements comprise plates of generally rectangular shape and said open portion comprises an elongated aperture therethrough adjacent said second end portion.

3. The anchor system of claim 2 wherein said plates comprise thin steel plates whereby said second ends thereof pierce said rigid insulation wall when said insulation wall is placed in abutment with an outer face of said backup wall.

4. The anchor system of claim 1 wherein said backup wall is of block construction having mortar joints and wherein said first end portion of said tieing elements is embeddable in said mortar joints.

5. The anchor system of claim 4 wherein said tieing elements further include indexing means for laterally spacing said second end portion relative to said backup wall so that said opening extends outwardly beyond said insulation wall when said tieing element is embedded in said mortar joint.

6. The anchor system of claim 5 wherein said tieing element comprises a generally rectangular plate and said indexing means comprises a knockdown tab thereon.

7. An anchor system for a wall system including a backup wall of block masonry construction having mortar joints, a veneer wall spaced outwardly from said backup wall, the anchor system comprising:

a wire joint reinforcement including parallel longitudinal rods connected by a plurality of cross rods, embeddable in said backup wall mortar joints;

a plurality of relatively thin plates of generally rectangular shape and having first and second ends;

rigid interconnection means for preforming a reinforcement and tie system between said wire joint reinforcement and said plates adjacent said first ends of said plates, said plates being longitudinally spaced with said plate second ends extenable outwardly from said backup wall;

a plurality of tie means for interconnecting said plates at said second ends thereof to said veneer wall to prevent relative inward and outward movement between said backup wall and said veneer wall; and means for permitting connection of backup wall and veneer wall mortar joints of different vertical alignment by cooperation of said tie means and said plates.

8. The anchor system of claim 7 wherein said plates include an elongated aperture therethrough adjacent said second end and said tie means include a leg portion receivable in said aperture for interconnecting said plate to said veneer wall.

9. The anchor system of claim 7 further comprising means mountable to said plates for engaging a wall of rigid insulation in contact with said backup wall.

10. The anchor system of claim 9 wherein said engaging means comprises a plurality of spring clip fasteners having a central portion receivable in said tieing element open portion, and opposed distal portions resiliently engaging said insulation wall to retain said insulation wall in contact with said backup wall.

11. An anchor system for a wall system including a backup wall of block masonry construction having mortar joints, brick veneer wall spaced outwardly from said backup wall and having mortar joints, the anchor system for interconnecting said walls comprising:

a plurality of plates of generally rectangular shape and having first and second ends, said plate first ends embeddable in said backup wall mortar joints, and said second ends extendable outwardly from said backup wall, said plates also including a downwardly extending tab disposed between said ends to engage said backup wall to laterally position said plates relative to said backup wall, and an elongated aperture adjacent to said second end;

a plurality of tie means including a first portion embeddable in said veneer wall mortar joints and a leg portion receivable in said plate apertures to prevent relative inward and outward movement between said backup wall and said veneer wall; and means for permitting connection of backup wall and veneer wall mortar joints of different vertical alignment by cooperation of said leg portions and said plate apertures.

12. The anchor system of claim 11 further comprising means mounted to said plates for engaging a wall of rigid insulation in contact with said backup wall.

13. The anchor system of claim 12 wherein said engaging means comprises a plurality of spring clip fasteners having a central portion receivable in said tieing element open portion, and opposed distal portions resiliently engagable with said insulation wall to retain said insulation wall in contact with said backup wall.

14. The anchor system of claim 11 wherein said tabs are laterally spaced from said aperture so that said aperture extends outwardly beyond said insulation wall when said plate is embedded in said mortar joint.

15. The anchor system of claim 13 wherein said tie means includes first and second leg portions receivable in opposite ends of said aperture, said spring clip being receivable in said aperture between said leg portions.

16. An anchor system for a wall system including a backup wall of block masonry construction having mortar joints, a brick veneer wall having mortar joints, and a space between said backup wall and said veneer wall, the anchor system for interconnecting the walls comprising:

a wire joint reinforcement including parallel longitudinal rods connected by a plurality of cross rods embeddable in said backup wall mortar joints;

a plurality of longitudinally spaced plates of generally rectangular shape and having first and second ends, said plates being secured to said wire joint reinforcement adjacent said first ends thereof, and said second ends extendable outwardly from said backup wall into said space, said plates including a downwardly extending tab disposed between said ends to engage said backup wall to laterally position said plate and wire joint reinforcement relative to said backup wall, and an elongated aperture adjacent to said second end;

tie means including a first portion embeddable in said veneer wall mortar joints and a leg portion receivable in said plate aperture to prevent relative inward and outward movement between said backup wall and said veneer wall; and means for permitting connection of backup wall and veneer wall mortar joints of different vertical alignment by cooperation of said leg portions and said plate apertures.

17. The anchor system of claim 16 further comprising means mountable to said plates for engaging a wall of rigid insulation in contact with said backup wall.

18. The anchor sytem of claim 17 wherein said engaging means comprises a plurality of spring clip fasteners having a central portion receivable in said tieing element open portion, and opposed distal portions resiliently engagable with said insulation wall to retain said insulation wall in contact with said backup wall.

19. The anchor system of claim 16 wherein said tab is laterally spaced from said aperture so that said aperture extends outwardly beyond said insulation wall when said plate is embedded in said mortar joint.

20. The anchor system of claim 18 wherein said tie means includes first and second leg portions receivable in opposite ends of said aperture, said spring clip being receivable in said aperture between said leg portions.

21. An anchor system for a wall system including a backup wall of block masonry construction having mortar joints, a brick veneer wall having mortar joints, a cavity between said backup wall and said veneer wall, and a wall of rigid insulation disposed between said backup wall and said brick wall partially filling said cavity, the anchor system for interconnecting said walls and comprises a wire joint reinforcement including parallel longitudinal rods connected by a plurality of cross rods, embeddable in said backup wall mortar joints;

a plurality of plates, of generally rectangular shape having first and second ends;

rigid interconnection means for preforming a reinforcement and tie system by welds between said wire joint reinforcement and said plates adjacent said first ends thereof with said plates longitudinally spaced and said second ends extendable outwardly through said rigid insulation into said cavity, said plates including a downwardly extending tab disposed between said ends to engage said backup wall to laterally position said plate and reinforcement relative to said backup wall and said insulation, and an elongated aperture adjacent and parallel to said second end disposed outwardly of said insulation;

a spring clip fastener receivable in said aperture engagable with said insulation wall to retain said insulation wall in contact with said backup wall; and a plurality of tie means including a generally U-shaped portion embeddable in said veneer wall mortar joints and leg portions receivable in said plate aperture to prevent relative inward and outward movement between said backup wall and said veneer wall.

22. The anchor system of claim 21 wherein said tab is laterally spaced from said aperture so that said aperture extends outwardly beyond said insulation wall when said plate is embedded in said mortar joint.

23. The anchor system of claim 21 wherein said tie means includes first and second leg portions receivable in opposite ends of said aperture, said spring clip being receivable in said aperture between said leg portions.

* * * * *